US005868323A

United States Patent [19]

Cantor

[11] Patent Number: 5,868,323

[45] Date of Patent: Feb. 9, 1999

[54] DISPENSING ORIFICE FOR LIQUID CONDIMENTS

[75] Inventor: Stuart Miles Cantor, Whippany, N.J.

[73] Assignee: Reckitt & Colman Inc., Wayne, N.J.

[21] Appl. No.: 802,410

[22] Filed: Feb. 18, 1997

[30] Foreign Application Priority Data

Mar. 16, 1996 [GB] United Kingdom ..... 9605569.4

[51] Int. Cl.[6] ..... A62C 31/02

[52] U.S. Cl. ..... 239/589; 239/601; 222/556; 222/575

[58] Field of Search ..... 239/589, 601; 222/562, 556, 566, 575; 215/235; 220/259, 339

[56] References Cited

U.S. PATENT DOCUMENTS

| | | | |
|---|---|---|---|
| 1,613,940 | 1/1927 | Copen | 222/575 |
| 1,699,532 | 1/1929 | Hopkins | 222/575 |
| 2,234,151 | 3/1941 | Williams | 222/575 |
| 2,961,167 | 11/1960 | Skaist | 239/601 |
| 3,187,964 | 6/1965 | Foster | 222/556 |
| 4,368,833 | 1/1983 | Burker | 222/575 |
| 4,473,168 | 9/1984 | Cox | 220/259 |
| 4,735,334 | 4/1988 | Abbott | 220/259 |
| 5,499,736 | 3/1996 | Kohl | 220/254 |

FOREIGN PATENT DOCUMENTS

| | | |
|---|---|---|
| 306499 | 8/1928 | United Kingdom . |

*Primary Examiner*—Andres Kashnikow
*Assistant Examiner*—Lisa Ann Douglas
*Attorney, Agent, or Firm*—Fish & Richardson P.C.

[57] ABSTRACT

A dispensing orifice for free-flowing, liquid condiments is provided. The dispensing orifice is adapted to be provided as a fitment for a container, especially for a bottle containing liquid condiments. The dispensing orifice provides for two modes of dispensing, a dropwise dispensing pattern, and a streamwise dispensing pattern.

16 Claims, 4 Drawing Sheets

DISPENSING ORIFICE FOR LIQUID CONDIMENTS

The present invention relates to fluid delivery systems. More specifically, the present invention relates to novel fitment constructions used in conjunction with a fluid dispensing device, especially as used for condiments.

BACKGROUND OF THE INVENTION

Fluid devices of many types are well known. Particularly, fluid dispensers and delivery devices useful for the delivery of liquid compositions, more specifically condiments are known to take a variety of forms. These include for example narrow necked bottles or flasks wherein the condiment is dispensed by tilting or over turning said flask and allowing the contents to pour out; flexible bottles or flasks which include a flow directing cap or tip, particularly a nozzle cap wherein compression of the bottle forces the delivery of its contents through said nozzle, as well as open-mouth bottles and jars which may be provided with a liquid dispensing means as complex as a pump, or as simple as a spoon.

Notwithstanding the present variety of such dispensing arrangements, there is still a need in the art for further improvements to liquid delivery devices especially as may be used in condiment dispensers. Further, there is a concurrent need in the art for improved processes for the delivery of liquids, particularly condiments.

BRIEF DESCRIPTION OF THE DRAWINGS

FIG. 1B-2 illustrates a perspective view of the bottom of the second fitment according to the prior art and illustrated on FIG. 1B-1;

FIG. 2 illustrates a top view of a fitment according to the present invention;

DETAILED DESCRIPTION OF THE INVENTION

According to the present invention, there is provided a fitment which is adapted to be sealably mounted upon the opening of a flask or other container. Any of a variety of known art containers may be used, and it need only be suitable for the containment of a liquid, desirably a quantity of a condiment which may be dispensed therefrom. Such a condiment is a liquid at room temperature, that is to say that its flowable behavior is to be differentiated from a condiment such as a mustard, mayonnaise, or other fluid which may exhibit thixotropic flow properties and which have different rheologies substantially dissimilar from a "free flowing" composition. Such materials may be differentiated as they are pasty or gellatious in their characteristics, and/or are non-pourable compositions and are typically dispensed under pressure to make them flow from a bottle (such as by squeezing a bottle) or are typically dispensed using an instrument (such as a knife) to spread them upon an edible composition. By way of non-limiting example liquid condiments which are considered "free flowing" compositions and which may be advantageously used with the fitments and containers according to the instant invention include a variety of aqueous based sauces, condiment preparations including but not limited to Worcestershire sauce, pepper sauces, flavoring sauces, a broad range of oils which may be optionally flavored, as well as others not particularly recited here but which exhibit similar Theological and viscosity characteristics at room temperature as these denoted aqueous based sauces. Desirably, the fitments according to the present invention find use with liquid condiments having a viscosity at least three times that of water, and most desirably are used in conjunction with liquid condiments having a viscosity of between about 500 to about 5000 centipoise at about 68° F., more desirably having a viscosity of between about 950 and 2000 centipoise at 68° F.

The fitments of the invention are used in a conventional manner and my be affixed to the container with which they find use according to the usual means. Such means include for example friction fitting wherein a portion of the fitment is inserted into the opening, such as the neck of a bottle or flask, mechanically fitting the fitment such as the use of mating screw threads on a portion of the fitment and on the container, gluing or heat sealing the fitment to the container, and most preferably "snap-fitting" wherein the periphery of the fitment is flexible to a sufficient degree such that it may be pressure fitted onto the opening of a container, be it a bottle, flask or jar.

The fitments according to the invention may be used with conventional bottles or flasks which may be supplied with various conventional closures including but not limited to: screw caps, snap fitted caps, lids, flip-top type dispensers, stoppered bottles, as well as other not particularly elucidated here.

Figure 1A:
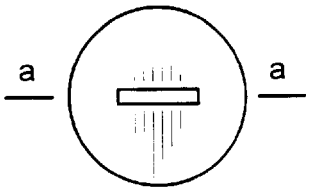
FIG. 1A PRIOR ART
FIG. 1A illustrates a top view of a first fitment according to the prior art.

An exemplary fitment, which is known to the prior art, includes that which is illustrated under FIG. 1A. As is thereon illustrated in a top view, the fitment is substantially circular and includes a fluid passage passing therethrough to permit the exit of the liquid. This fluid passage is a centrally located rectangular slot which has a width of approximately 0.10 inches, and a height of approximately 0.45 inches. The width, which is coincident upon axis a—a also illustrated on FIG. 1 for the sake of convenient reference, may be found on presently commercially available condiment preparations, including FRENCH's Worcestershire Sauce (Reckitt & Colman Inc., Montvale N.J.). Such fitments are "snap fitted" onto bottles in a conventional manner and provide a fluid tight seal except for the fluid passage noted above. Such a fitment provides for a restricted fluid flow when the bottle is tilted or turned such to permit the flow of its contents to issue through the rectangular opening of the fitment as illustrated. With such a fluid condiment and with such fitments, it has been found that when the direction of the fitment is in a vertical direction, that is to say that the reference axis a—a is perpendicular to the horizontal, essentially the same fluid flow characteristics have been observed as when the rectangular slot is positioned such that its reference axis a—a is substantially parallel to the horizontal. In both cases, a fluid stream issues from the bottle.

Figures 1, 1B:
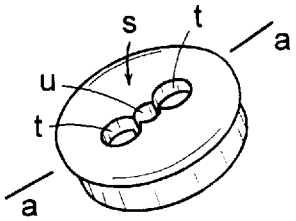
FIG. 1B-1 PRIOR ART
FIG. 1B-1 illustrates a perspective view of the top of a second fitment according to the prior art; FIG.
Figures 1, 1B, 2:
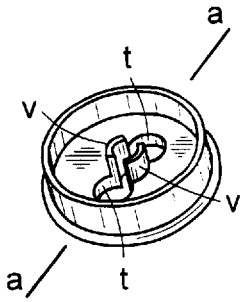
FIG. 1B-2 PRIOR ART
Figure 2:
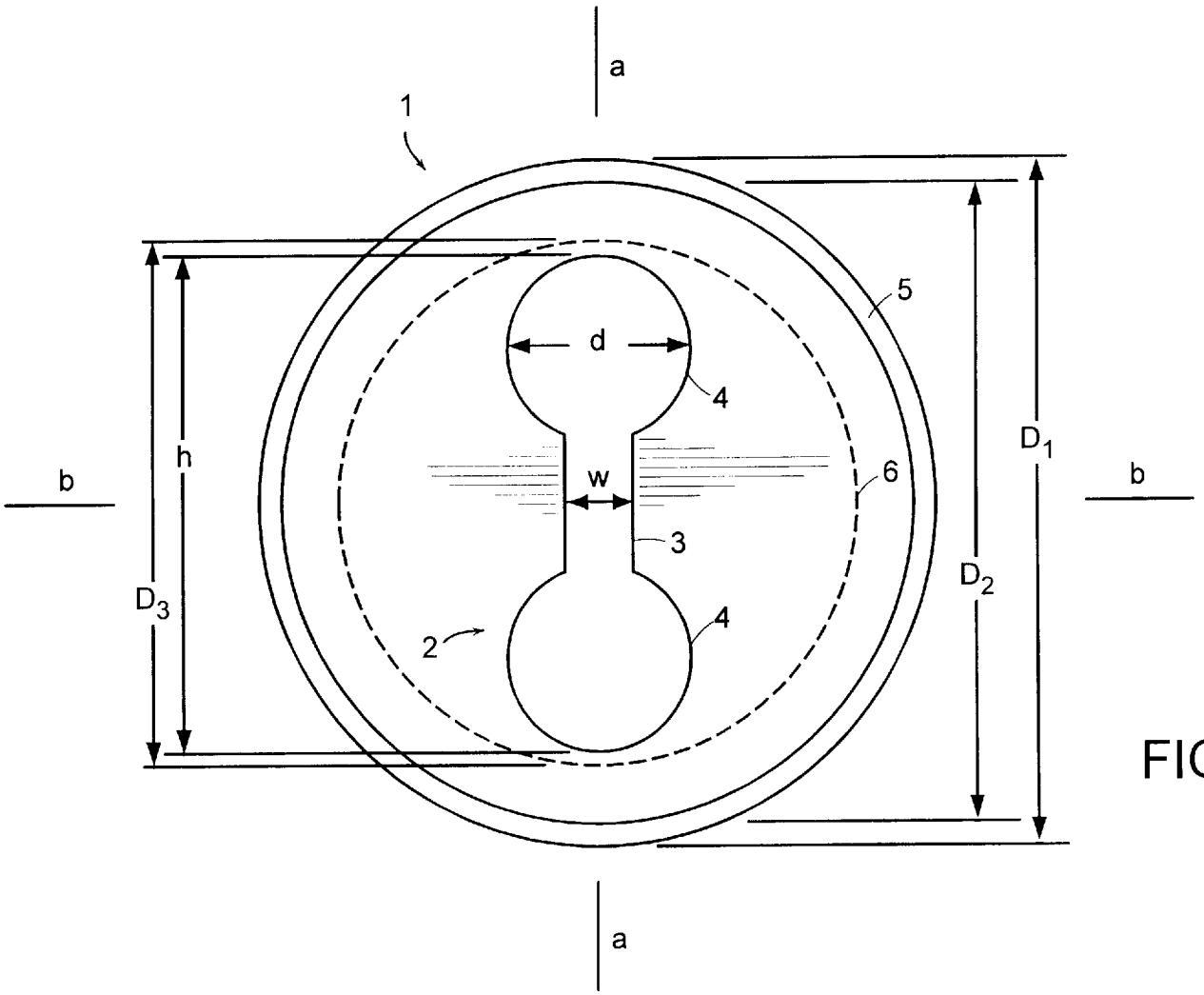

A second exemplary fitment, which is known to the prior art, includes that which is illustrated under FIGS. 1B-1 and 1B-2. As is thereon illustrated in a top view, the fitment is substantially circular and includes a fluid passage passing therethrough to permit the exit of the liquid. This fluid passage is a centrally located passage (s) having two oval shaped end regions (t) in part intersected and connected by a circular central region (u) which has a significantly smaller diameter than that of the two oval shaped end regions (t) which are identical in size. The central axis of this centrally located passage (s) is coincident upon axis a—a also illustrated on FIGS. 1B-1 and 1B-2 for the sake of convenient reference. Further this fitment includes two concave arms (v) which extend downwardly and into the interior of a bottle when the fitment is installed. These concave arms (v) depend from the circular central region (u) and extend perpendicularly therefrom. Such a fitment may be found on presently on a commercially available condiment preparation, ANGOSTURA Worcestershire Sauce (Angostura International Ltd., Cranford N.J.). Such fitments are "snap fitted" onto bottles in a conventional manner and provide a fluid tight seal except for the centrally located passage noted above. Such a fitment provides for two flow patterns; a restricted dropwise flow pattern when the fitment is oriented such that the reference axis a—a is substantially vertical, and a less restricted, streamwise flow pattern when the fitment is oriented such that the reference axis a—a is substantially horizontal.

The present inventor has surprisingly found that a modification of the present known art fitment design leads to surprising and substantially improved fluid delivery characteristics, particularly where such fitment is used in conjunction with a container wherein a liquid, especially a liquid condiment composition, particularly those having a viscosity at least three times that of water, and most particularly those having a viscosity of from 950–2000 centipoise/second ("cps") at room temperature is to be used.

Turning now to FIG. 2, therein is illustrated a preferred embodiment of a fitment according to the present invention. Therein is illustrated in top view of a fitment generally indicated as 1 which includes a fluid opening, generally indicated as 2. Such a fluid opening includes a central portion 3 which has a width "w" and a height "h" as well as two end portions thereof, both indicated by 4. The central portion 3 and the end portions 4 form a fluid opening 2 passing through the fitment 1 and permit the passage of liquid therethrough. Each of these end portions has a diameter "d" as is illustrated on FIG. 2, and may generally be seen to be essentially circular in cross-section, being interrupted only by the width of the central portion 3. From this top view perspective, it may also be seen that the fitment 1 includes a peripheral margin wall 5 adapted to be affixed to the end of a bottle or container, and therein is further indicated by the presence of the dotted line 6, the approximate dimension of the opening of a bottle upon which the fitment 1 is to be affixed. For sake of convenient reference, therein are also indicated two reference axis, a first axis a—a which is approximately coincident with the central axis of the central portion 3 and parallel to its two sides, and a second axis b—b which is perpendicular to the prior axis a—a which is also approximately central to the fluid opening 2 and bisects the same.

From FIG. 2, therein can be seen that in accordance with the preferred embodiment therein described fluid opening 2 is symmetric about both of these axis; namely, if the reference axis a—a is extended therethrough, that the dimensions of the fluid opening 2 are symmetric thereabout, and the like may be said wherein reference axis b—b is extended, that the dimensions of the fluid opening 2 are also symmetrical thereabout.

With regard to the specific dimensions, particularly as that shown in the embodiment of FIG. 2, it is to be appreciated that a significant degree of variation may be exercised in the selection of the dimensions indicated by h, w and d. It is to be expected that as the fitment according to the invention may be utilized with a variety of fluids, optimization of one or more of these dimensions in order to provide the desired fluid delivery characteristics described in more detail below is to be expected. The inventor has however found that advantageously the dimensions of w desirably do not exceed ½ of the dimension d and preferably does not exceed about ⅓ of the dimension of d, and that the dimension h is approximately at least 2 to 2½ times the dimension d.

With further regard to FIG. 2, and specific dimensions it is to be understood that the outer diameter $D_1$, the inner diameter $D_2$ and the diameter of the bottle or other container at the point of contact with the fitment $D_3$, such may be varied with the sole requirement that D3 be at least as large as the dimension h, but is desirably at least slightly greater than h.

Figure 3:
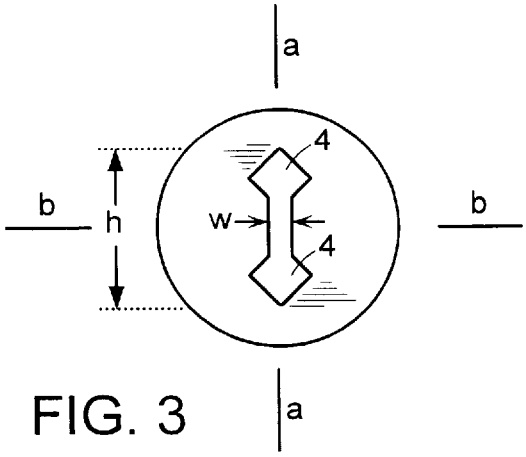
FIG. 3 illustrates one alternative embodiment of a fitment according to the present invention, in top view.

Turning now to FIG. 3, therein is shown a first alternative embodiment of the invention wherein the two end portions 4 have a non-circular configurations, here an approximately diamond-shaped configuration which is uninterrupted save for the intersection of the central portion 3. Also illustrated are reference axes a—a and b—b.

Figure 4A:
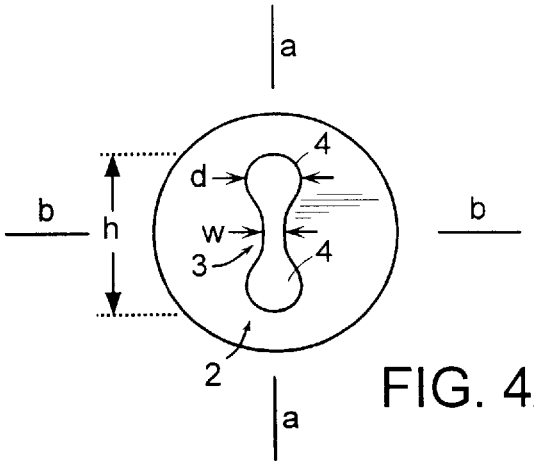
FIG. 4A illustrates a second alternative embodiment of a fitment according to the present invention, in top view.

FIG. 4A illustrates yet a further embodiment of the present invention wherein is shown a fluid opening 2 which has a central portion 3 which has arcuate sides which extend from the radii of two circular end portions 4, which arcuate sides tend to converge near the central most portion of the fluid opening 2, which is coincident with the intersection of reference axis a—a and b—b.

Figure 4B:
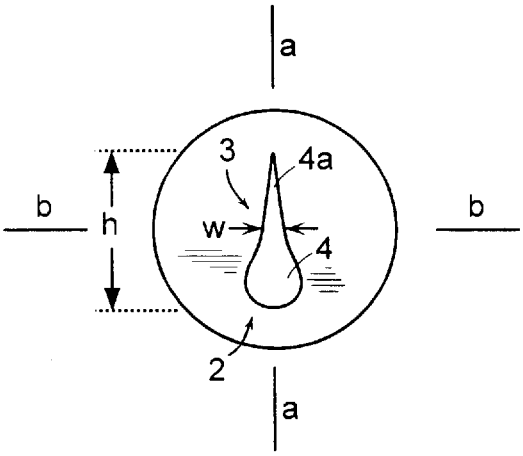
FIG. 4B illustrates a third alternative embodiment of a fitment according to the present invention, in top view.

FIG. 4B illustrates yet a further embodiment of the present invention which is similar to at illustrated on FIG. 4A. Again is shown a fluid opening 2 which has a central portion 3 which has arcuate sides which extend from the radius of one circular end portion 4, which arcuate sides tend to converge near the central most portion of the fluid opening 2, which is coincident with the intersection of reference axis a—a and b—b. The central portion tapers and terminates at a second end portion 4*a* at the opposite side of reference axis b—b.

With regard to these embodiments, it is to be understood that those illustrated on FIG. 2, FIG. 3, FIGS. 4A and 4B are merely provided for the sake of illustration and that other embodiment may also be possible. These include, for example, wherein the fluid opening is non-symmetrical about one or more of the axis a—a and b—b, such as wherein there is provided only a central portion 3 and a single end portion 4 wherein the dimension d is greater than w, but is preferably at least 2 w, and most preferably is 2½ w. Most desirably, the fluid openings of the fitments according to the inventions are symmetrical about both axis a—a and b—b. Such symmetrical configurations ultimately provide an easy-to-use fitment wherein two possible liquid flow patterns are provided, a first flow pattern wherein the fluid fitment is such that one of the two end regions 4 is in a downward direction and the reference axis b—b is horizontal, and a second flow pattern wherein the fitment is oriented such that the axis a—a is horizontal. In the former, first orientation, a streamwise liquid flow pattern is provided, and the contents of the bottle are more quickly dispensed than in the latter, second orientation wherein a dropwise liquid flow pattern is provided.

Accordingly, the use of the fitments according to the present invention is particularly desirable for liquids, especially condiments, wherein such both streamwise and dropwise liquid flow patterns are desired. Such dual flow patterns would be very desirable with liquid condiments which are of a hot and spicy nature such as "pepper sauces" as well as other condiments and preparations wherein the addition of only minor amounts, i.e., a "few drops" is to be desired. The fluid fitments of the present invention provide both for the easy and rapid dispensation of contents when used to deliver a streamwise liquid flow pattern, which may be desired when a larger amount of said condiment is required for the preparation of a large or multiple portion of a food stuff being prepared. At the same time, the fluid fitments of the invention permit for a dropwise liquid flow pattern which is advantageous when used as a tabletop condiment where only one or several drops are metered and dispensed. Such dual liquid delivery patterns provide for a condiment container which has not been known to the art, and which advantageously may be conveniently used for dispensing of both larger and smaller amounts of liquid condiments, no longer requiring the removal of the fitment to permit the rapid delivery of a liquid condiment from a container, and subsequent replacement onto the container. Further, the fitments of the present invention minimize the likelihood that fitments which are temporarily removed from a container are lost or misplaced before they are replaced.

Figure 5:
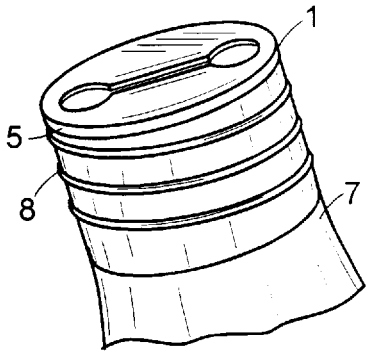
FIG. 5 illustrates a perspective view of a fitment according to the present invention as it is attached to a container.

Turning now to FIG. 5 therein is shown a perspective view of the fitment of FIG. 2 as it is affixed to a portion of a fluid container 7. As is thereupon seen, the fitment includes a peripheral margin 5 which is readily "snapped on" to a corresponding portion of the neck of the container 7, of which only a part is shown. Such is a conventional mode of affixation and is preferred for use with the fitments according to the present invention as the cap may be readily attached to said container following its filling, and does not require glues, or other mechanical means to retain it in its position. Such a snap fit also desirably provides an excellent fluid resistant seal about the periphery of the fitment 1. As is also shown on FIG. 5, the container 7 also includes threads 8 which are adapted to be mated with corresponding threads of a screw cap (not shown) such that the screw cap may be attached to the container 7 and provide a liquid tight seal over the fitment 1 in a conventional manner.

The fitments of the invention may be differentiated from certain known art fitments as they are substantially planar in their construction and but for the peripheral margin wall 5 adapted to be affixed to the end of a bottle or container, no other element extends from the substantially planar body of the fitments of the invention. Such a construction as the applicant presently provides is far simpler to fabricate in mass quantities, and is far easier to design a molding die cavity for.

Figure 6:
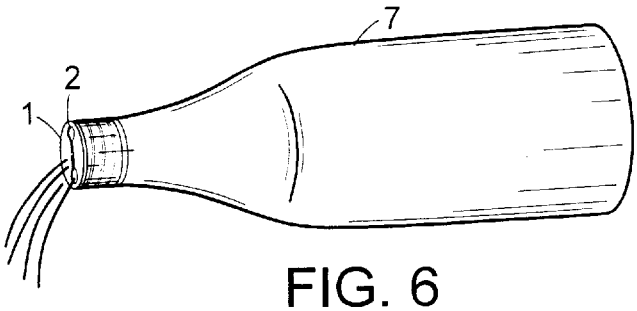
FIG. 6 illustrates a fitment according to the present invention as it is attached to a liquid container as well as a first liquid dispensing pattern as is provided by the invention.

FIG. 6 illustrates a first embodiment of a liquid dispensing process according to the present invention. Thereupon, having a fitment 1 according to the invention attached thereupon is rotated such that the fluid opening 2 is positioned for providing a streamwise fluid delivery pattern. Such an orientation corresponds to reference axis b—b as shown on FIGS. 2–4 being approximately horizontal.

Figure 7:
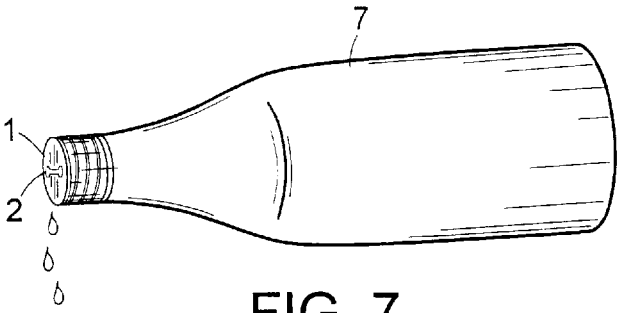
FIG. 7 illustrates a fitment according to the present invention attached to a liquid container, as well as further illustrating a second liquid dispensing pattern as provided by the present invention.

FIG. 7 illustrates the same container and fitment of FIG. 6, however, rotated by 90° along the axis of said container in which manner the fitment is position such to provide a "drop wise" fluid delivery pattern. Such an orientation corresponds to reference axis a—a as shown on FIGS. 2–4 being approximately horizontal.

The fitments according to the invention may be produced from a variety of known materials, including but not limited to, metals, wood, cork, and most desirably from one or more polymer materials. Such materials are known to the art for the manufacture of fitments, but the use of polymers are generally preferred as they are relatively low in cost, may be produced to good dimensional tolerances, and provide a sufficient degree of flexibility such that the periphery of the fitment may be flexed sufficiently so to be easily snap-fitted onto a container, and provide a liquid-tight seal with the end of the container upon which it is to be used. Examples of such polymers include, without limitation, polyethylene, polypropylene, polybutylene, nylon, as well as co-polymers of one or more. Desirably, where such a fitment is intended to be used in a condiment dispensing device, such a polymer is a food grade plastic or polymer material. Such are known, per se, to the art.

The fitments may also be formed as an integral part of a bottle or flask, such as being molded into the neck of such a bottle or flask. In such a manner, the fitment is no longer a separate element which is fittable into a bottle or flask but is an integrated part thereof.

Figure 8:
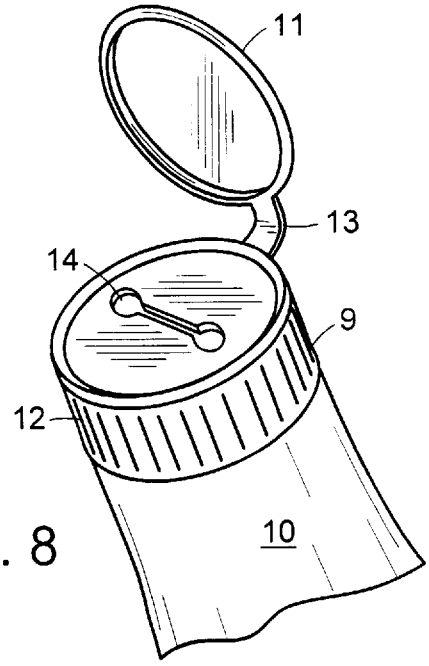
FIG. 8 illustrates a fitment according to the present invention which is integrally formed as part of a flip top type cap.

The fitments may also be formed as an integral part of a flask or bottle closure. Illustrated of FIG. 8 is a flip-top type closure 9 mounted on the end of a bottle 10 by means of mating engaging threads (not shown). The closure includes a top portion 11 and a body portion 12 connected to by a hinge 13 which are suitably dimensioned such that when the top portion 11 is closed upon the body portion 12 a liquid seal tight closure is formed which denies the passage of any liquid from the interior of the bottle 10 through the fluid opening 14. As may be seen from FIG. 8 the fluid opening 14 is one generally in accordance with the fluid opening shown and discussed with reference to FIG. 2, above. Such a fitment as shown on FIG. 8 provides a dual function to the bottle or flask with which it is used. A first function is that of providing a liquid seal tight closure to the bottle or flask; a second function is of providing the dual fluid delivery patterns as generally discussed above, and as specifically discussed in conjunction with FIGS. 6 and 7.

EXAMPLE 1

Two glass bottles of identical configuration were provided with approximately 12 ounces of a pepper sauce condiment, FRANK'S RED-HOT (which was measured and determined to have a viscosity of approximately 950 cps to 2,000 cps (centipoise/second), at room temperature (approx. 68° F./20° C.). On the first of said bottles was provided a fitment according to the prior art as is particularly illustrated on FIG. 1. The fitment had a fluid opening having a width of 0.10 inch and a height of 0.45 inch. The fitment was affixed in a conventional manner by readily manually "snapping on" it to the end of the bottle, with the periphery of the fitment providing a fluid tight seal. To the second glass bottle was affixed a fitment according to the present invention and as more specifically illustrated on FIG. 2, the fitment thereupon had the following dimensions: d=0.24 inch, w=0.10 inch, and h=0.70 inch. The outer dimensions of the fitment of FIG. 2 were essentially the same as that of FIG. 1 and these two fitments differed only in the configuration of their fluid openings.

In order to evaluate the flow delivery characteristics of these two fitments, a test rack having a platform inclined approximately 45° from the horizontal was provided. This test included holding means for both bottles. Next, separate pieces of a plastic adhesive tape were placed over the fluid openings of the respective fitment; this tape provided a simple valve means wherein the fluid contents were retained until the test was initiated. The bottles were then mounted in the test rack, with their necks and fitments facing downward. With respect to the bottle having the prior art fitment as illustrated on FIG. 1, the fitment was oriented such that the axis a—a as shown on FIG. 1 was vertical. In a similar fashion, the fitment according to the invention, as that shown on FIG. 2 was similarly position also with its axis a-was vertical. Two fluid containers were provided below the fitments of the bottles for accepting the dispensed contents, and a stop watch was prepared.

Both of the tapes were removed from the fitments simultaneously with the initiation of the stop watch. The contents were allowed to dispense under the force of gravity from the bottles positioned within the test stand until each bottle was empty, at which point the time was noted. It was observed that the bottle having the prior art fitment required approximately 120 seconds for the complete dispensation of its fluid contents, wherein surprisingly the bottle containing the fitment according to the invention required only about 50 seconds for the dispensation of its contents.

EXAMPLE 2

A further bottle was provided with a quantity of FRANK'S RED-HOT pepper sauce and the fitment as illustrated on FIG. 2 was affixed thereupon. The bottle was manually lifted and oriented such that the fitment was positioned with its axis a—a approximately parallel to the horizontal. It was observed that a dropwise pattern, which was very easy to meter and control, was dispensed from the bottle.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

I claim:

1. A fitment for a bottle or flask containing a liquid having a viscosity at about 68° F., of at least about three times that of water to about 5000 cps, said bottle or flask having a fluid opening adapted to permit the passage of the liquid therethrough, wherein the fluid opening includes at least one end portion having a dimension d, a central portion having a width w, and where the fluid opening has a height h wherein w does not exceed ½ of the dimension d, and, the dimension h is at least 2 times the dimension d.

2. The fitment according to claim 1 wherein the dimension h is between 2 and 2½ times the dimension d.

3. The fitment according to claim 2 wherein the dimension w does not exceed about ⅓ of the dimension d.

4. The fitment according to claim 1 wherein the end portion is substantially circular.

5. The fitment according to claim 1 having two end portions of dimension d.

6. The fitment according to claim 5 wherein both of the two end portions are substantially circular.

7. The fitment according to claim 1 wherein the liquid contained in the bottle has a viscosity of between about 950–2000 cps at about 68° F.

8. A fitment for a bottle or flask according to claim 1 containing a free flowing liquid, said bottle or flask having a fluid opening adapted to permit the passage of the free flowing liquid therethrough, wherein the fluid opening includes at least one end portion which is substantially circular, a central portion which is substantially rectangular and wherein the width of the central portion is not more than ½ of the diameter of the substantially circular end portion, and where at least a part of the central portion is contiguous with the end portion.

9. A fitment for a bottle or flask according to claim 8, wherein the fluid opening includes at least two end portions each of which is substantially circular, and a central portion which is substantially rectangular and which has two opposite ends, and wherein the width of the central portion is not more than ½ of the diameter of the substantially circular end portion, where one end of the central portion is contiguous with a first one of the two end portions, and where the opposite end of the central portion is contiguous with the second one of the two end portions.

10. A fitment for a bottle or flask according to claim 1 containing a free flowing liquid, said bottle or flask having a fluid opening adapted to permit the passage of the free flowing liquid therethrough, wherein the fluid opening includes at least one end portion which is substantially circular, a central portion which has two opposite ends, and two inwardly directed arcuate sidewalls between said opposite ends, and wherein the maximum width of the central portion is not more than ½ of the diameter of the substantially circular end portion, where one end of the central portion is contiguous with a first one of the two end portions, and where the opposite end of the central portion is contiguous with the second one of the two end portions.

11. A closure for a bottle or flask comprising a fitment according to claim 1.

12. A closure according to claim 7 wherein the end portions are substantially circular and have the same dimensions d.

13. A flip top type closure according to claim 7.

14. A process for dispensing a liquid condiment from a flask or container which comprises the steps of:

providing a quantity of a liquid having a viscosity at about 68° F., of at least about three times that of water to about 5000 cps liquid condiment in a flask or container which comprises a fitment having a fluid opening adapted to permit the passage of the liquid condiment therethrough, wherein said fluid opening has at least one end portion of a dimension d, a central portion having a width w, and said fluid opening has a height h, wherein w does not exceed ½ of the dimension d, and, the dimension h is at least 2 times the dimension d;

tilting the liquid condiment containing flask or container in a first orientation so to dispense the liquid condiment in a fluid stream.

15. The process according to claim 14 which comprises the further process step of:

tilting the liquid condiment containing flask or container in a second direction such that the fitment is oriented perpendicular to said first orientation so to dispense the liquid condiment in a dropwise pattern.

16. The process according to claim 14 wherein the liquid condiment has a viscosity of about 950–2000 cps at about 68° F.

* * * * *